US007128597B2

(12) United States Patent
Niitsu et al.

(10) Patent No.: US 7,128,597 B2
(45) Date of Patent: Oct. 31, 2006

(54) FLAT CIRCUIT CONNECTOR WITH MAGNETIZED ACTUATOR

(75) Inventors: Toshihiro Niitsu, Machica (JP); Hideki Iijima, Yamato (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/507,704

(22) PCT Filed: Mar. 6, 2003

(86) PCT No.: PCT/US03/06887

§ 371 (c)(1),
(2), (4) Date: Apr. 4, 2005

(87) PCT Pub. No.: WO03/083999

PCT Pub. Date: Oct. 9, 2003

(65) Prior Publication Data

US 2005/0170671 A1 Aug. 4, 2005

(51) Int. Cl.
*H01R 12/24* (2006.01)

(52) U.S. Cl. ..... 439/495; 439/260

(58) Field of Classification Search ..... 439/495, 439/67, 339, 39, 260, 331; 339/12
See application file for complete search history.

(56) References Cited

U.S. PATENT DOCUMENTS 4,156,265 A * 5/1979 Rose ..... 361/179
4,317,969 A * 3/1982 Riegler et al. ..... 200/52 R
4,451,113 A * 5/1984 Zuniga ..... 439/40
5,385,478 A * 1/1995 Niekawa ..... 439/67
5,409,407 A * 4/1995 Mizuno et al. ..... 439/860
5,843,567 A * 12/1998 Swift et al. ..... 428/221
6,267,602 B1 * 7/2001 Mendelson et al. ..... 439/39
6,338,648 B1 * 1/2002 Miura et al. ..... 439/495
6,565,363 B1 * 5/2003 Downing ..... 439/39
6,727,477 B1 * 4/2004 Li-Chen ..... 219/494
2003/0087536 A1 * 5/2003 Ito et al. ..... 439/38

* cited by examiner

*Primary Examiner*—Tulsidas C. Patel
*Assistant Examiner*—Vladimir Imas
(74) *Attorney, Agent, or Firm*—Stephen Z. Weiss

(57) ABSTRACT

An electrical connector is provided for terminating a flat electrical circuit. The connector includes a dielectric housing having an opening for receiving an end of a flat circuit. A plurality of terminals are mounted on the housing and have contact portions exposed in the opening. An actuator is movably mounted on the housing for movement between an open position and a closed position. In the open position, the actuator allows the flat circuit to be inserted into the opening. In the closed position, the actuator biases the flat circuit against the contact portions of the terminals. The actuator is magnetized, and a second magnetic component is mounted for drawing the actuator to its closed position due to magnetic attraction forces between the magnetized actuator and the magnetic component.

17 Claims, 6 Drawing Sheets

FLAT CIRCUIT CONNECTOR WITH MAGNETIZED ACTUATOR

FIELD OF THE INVENTION

This invention generally relates to the art of electrical connectors and, particularly, to a connector for terminating a flat circuit, such as a flat flexible circuit, a flexible printed circuit or other flat electrical cable.

BACKGROUND OF THE INVENTION

A wide variety of electrical connectors have been designed for terminating flat cables or circuits, such as flat flexible cables, flexible printed circuits or the like. A typical connector, generally designated 20, is illustrated in FIGS. 15–17 according to the prior art. Connector 20 includes an elongated dielectric housing 22 which mounts a plurality of terminals 24 arranged in a side-by-side array. The terminals are generally parallel to each other and are spaced laterally along an elongated circuit-receiving opening 26 into which a flat circuit 28 is inserted in the direction of arrow "A". Housing 22 may be adapted for mounting on a printed circuit board 30 (FIG. 17), and a pair of metal fitting nails 32 may be used for mounting the connector to the circuit board, such as by soldering the fitting nails to appropriate mounting pads on the board. Terminals 24 have tail portions 24*a* for connection, as by soldering, to appropriate circuit traces on the circuit board.

An elongated actuator 34 is pivotally mounted on housing 22 for pivotal movement between an open position shown in FIG. 15 and a closed position shown in FIGS. 16 and 17. In the open position, the actuator allows flat circuit 28 to be inserted into opening 26. In the closed position, the actuator biases the flat circuit against contact portions of terminals 24 exposed in the opening.

One of the problems with elongated flat circuit connectors 20 as described above and shown in FIGS. 15–17 is the inability to provide sufficient biasing forces on the flat circuit when the actuator is moved to its closed position. This problem is magnified when the number of terminals increases which, thereby, increases the length of the connector and the resulting length of the actuator. The longer the actuator, the more prone the actuator is to bow between its opposite ends and not apply sufficient pressure to the flat circuit.

A simple solution to the problem of providing sufficient biasing forces by the actuator, would be to simply increase the thickness of the actuator so that it is sufficiently robust to apply adequate pressures. However, with the increasing miniaturization of electronic devices in which such flat circuit connectors are used, such miniaturization requires a low profile connector, and increasing the thickness of the actuator undesirably increases the height of the connector. The present invention is directed to solving these problems or dilemmas by providing a low profile actuator which is magnetized and is drawn or pulled against the flat circuit by magnetic means mounted on the connector.

SUMMARY OF THE INVENTION

An object, therefore, of the invention is to provide a new and improved electrical connector for terminating a flat electrical circuit and to increase the biasing forces of an actuator of the connector in terminating the flat circuit.

In the exemplary embodiment of the invention, the connector includes a dielectric housing having an opening for receiving an end of a flat circuit. A plurality of terminals are mounted on the housing in a side-by-side array. The terminals have contact portions spaced laterally along the opening. An actuator is movably mounted on the housing for movement between an open position and a closed position. In the open position, the flat circuit is allowed to be inserted into the opening. In the closed position, the actuator biases the flat circuit against the contact portions of the terminals. The actuator is provided with first magnetic means. Second magnetic means are provided for drawing the magnetized actuator to its closed position due to the magnetic attraction forces between the first and second magnetic means.

The invention contemplates various systems for magnetizing the actuator, i.e. providing the first magnetic means thereon. For instance, the actuator may be at least partially molded of a magnetic material, or the actuator may be molded substantially entirely of the magnetic material. The magnetic material may be provided by a matrix having magnetic particles, such as ferrite particles, embedded therein. The actuator also my be magnetized by providing a permanent magnet thereon. For instance, with the actuator being elongated, the permanent may be disposed generally centrally between opposite ends of the elongated actuator.

The invention contemplates that the second magnetic means can be provided in a variety of manners. For instance, the second magnetic means may be disposed on the housing for drawing or pulling the actuator downwardly against the flat circuit. The second magnetic means may be provided by at least one permanent magnet affixed to the housing. Alternatively, the housing may be molded partially or entirely of magnetic material such as a matrix having magnetic particles, such as ferrite particles, embedded therein.

Another system for providing the second magnetic means is available when the connector is mounted on a printed circuit board. The second magnetic means may be provided on the circuit board, itself. The second magnetic means may comprise a molded magnetic material. In addition, the circuit board may be laminated with at least one magnetic layer.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
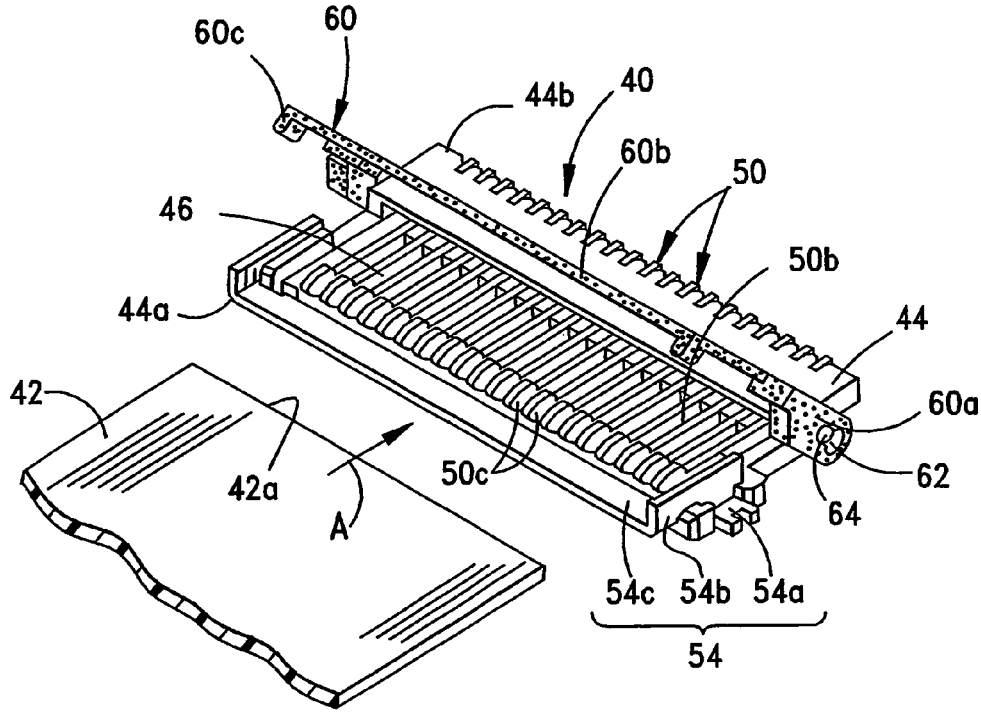
FIG. 1 is a perspective view of a flat circuit connector according to the invention, with the actuator in its open position.
Figure 2:
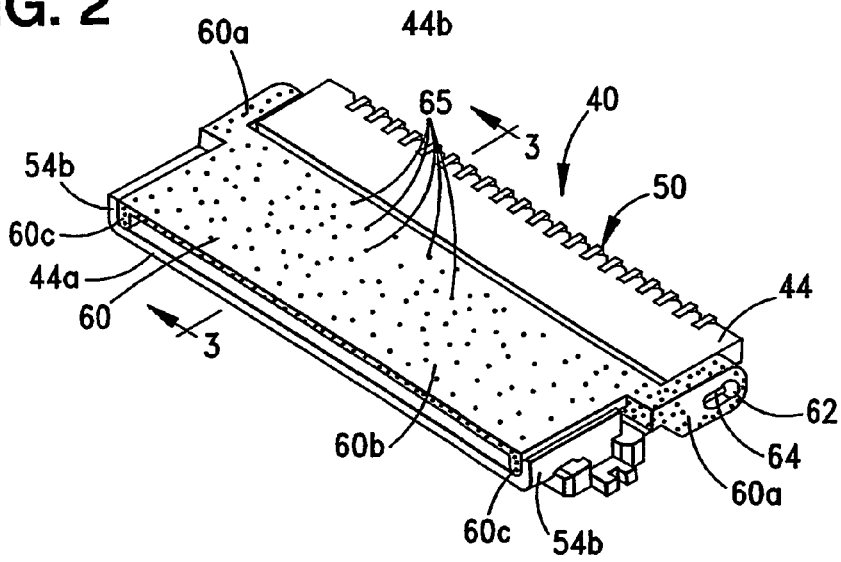
FIG. 2 is a view similar to that of FIG. 1, with the actuator in its closed position.
Figure 3:
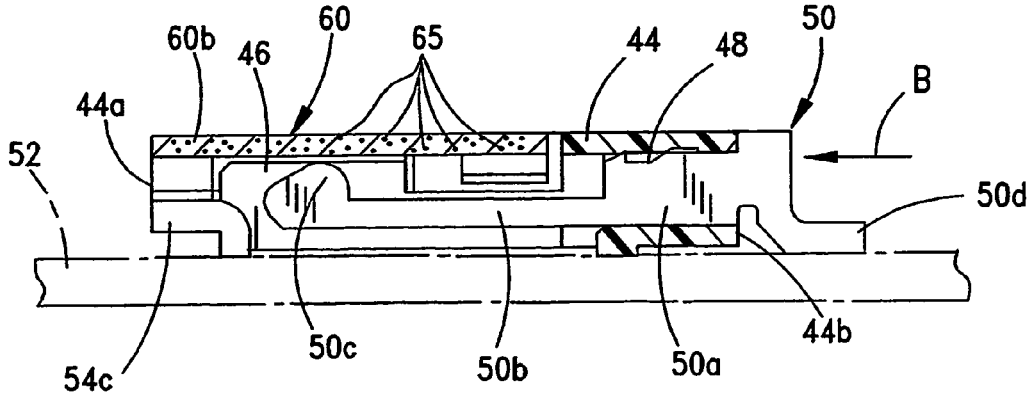
FIG. 3 is an enlarged vertical section, taken generally along line 3—3 of FIG. 1.
Figure 4:
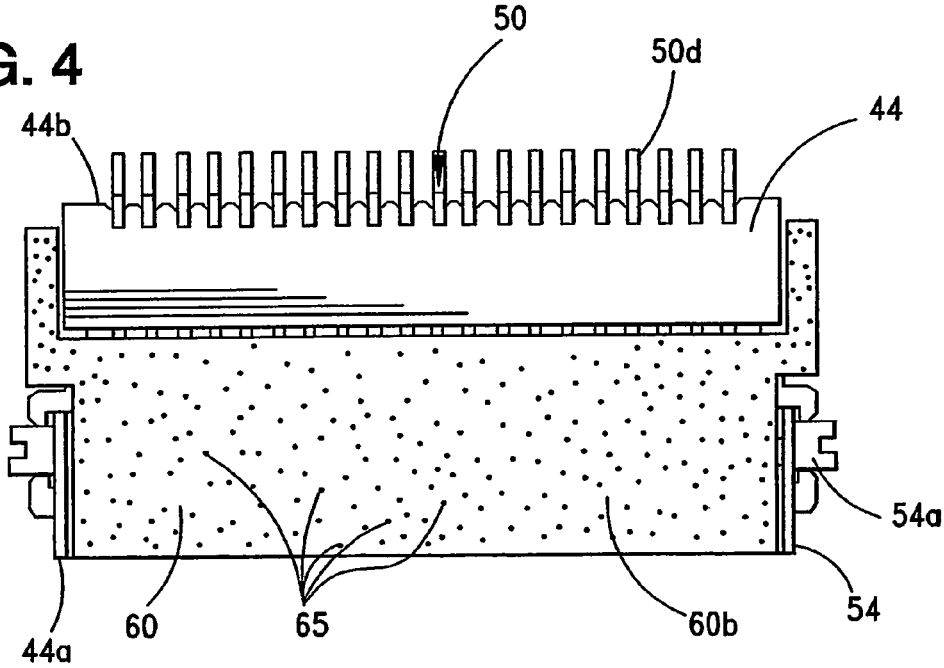
FIG. 4 is a top plan view of the connector.

Referring to the drawings in greater detail, and first to a first embodiment of the invention shown in FIGS. 1–7, the invention is embodied in an electrical connector, generally designated 40, for terminating a flat electrical circuit 42. The connector includes an elongated dielectric housing 44 which, at least in part, defines an elongated opening 46 for receiving an end 42*a* of flat circuit 42. The housing defines a front mating end 44*a* of the connector and a rear terminating end 44*b*. As seen in FIG. 3, housing 44 has a plurality of terminal-receiving passages 48 for receiving a plurality of terminals 50. Each terminal includes a mounting portion 50*a* which is press-fit into a respective passage in the direction of arrow "B". A contact arm 50*b* extends forwardly and defines a contact portion 50*c* at a distal end of the arm, with the contact portion projecting upwardly into circuit-receiving opening 56. A tail portion 50*d* of each terminal projects rearwardly beyond rear terminating end 44*b* of the housing for connection, as by soldering, to a printed circuit board 52 on which the connector is mounted.

A fitting nail plate 54 (FIG. 1) is mounted along the front mating end 44*a* of the connector, below circuit-receiving opening 46. The fitting nail is fabricated of metal material and may be connected, as by soldering, to mounting pads on the printed circuit board. Alternatively, a pair of mounting ears 54 may project from opposite ends of the fitting nail plate for securing, as by appropriate fasteners, to the printed circuit board. The fitting nail plate is formed with a pair of side walls 54*b* at opposite ends of a bottom wall 54*c*. According to the magnetic concepts of the invention, fitting nail plate 54 is fabricated of a magnetic material such as iron in order to provide a magnetic means-running along the length of circuit-receiving opening 46 generally below contact portions 50*c* of terminals 50, but at least below flat circuit 42 when the circuit is inserted into the connector.

Figure 5:
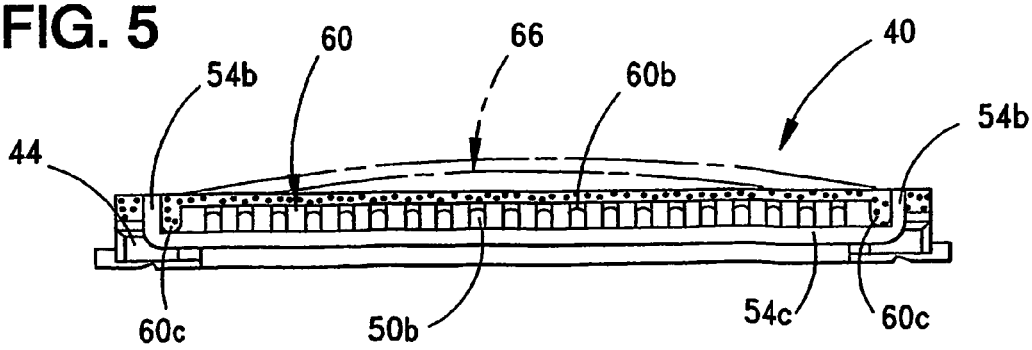
FIG. 5 is a front elevational view of the connector, showing in phantom lines the configuration of the actuator if the concepts of the invention are not used.
Figure 6:
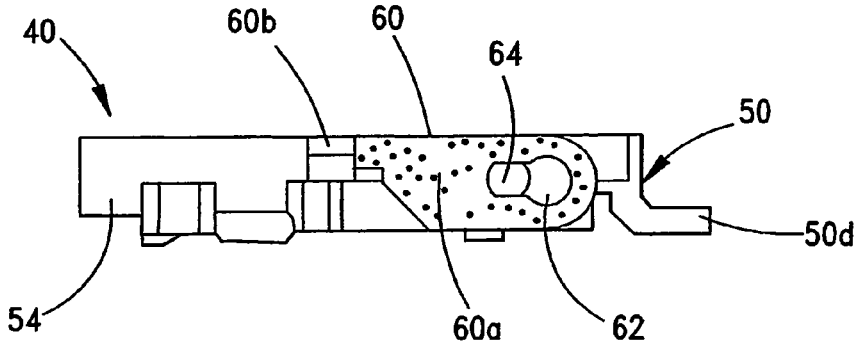
FIG. 6 is a side elevational view of the connector, looking at the right-hand side of FIG. 4.
Figure 7:
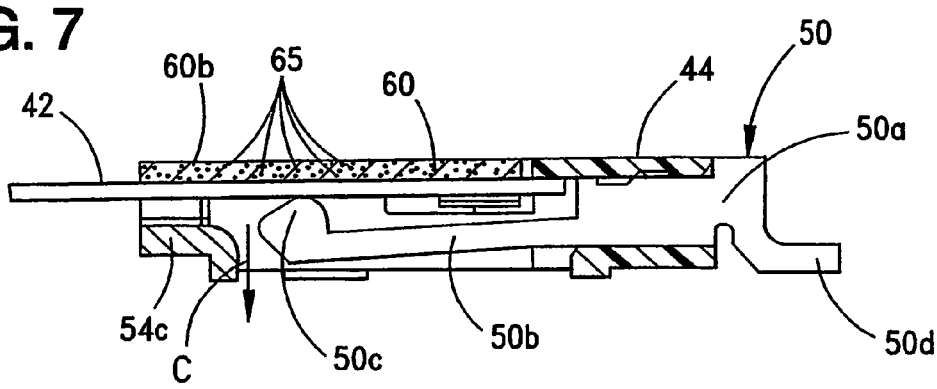
FIG. 7 is a view similar to that of FIG. 6, with a flat circuit inserted into the connector.

An elongated actuator, generally designated 60, is movably mounted on housing 44 for movement between an open position shown in FIG. 1 and a closed position shown in FIGS. 2–6. In the open position of FIG. 1, flat circuit 42 is allowed to be inserted into opening 46 in the direction of arrow "A". In the closed position of the actuator, the actuator biases the flat circuit downwardly in the direction of arrow "C" (FIG. 7) against contact portions 50*c* of terminals 50. The flat circuit has conductors (not shown) on the bottom surface thereof for engaging contact portions 50*c* of the terminals. The actuator has a pair of bearing arms 60*a* at opposite ends of a generally rectangular body portion 60*b*. The bearing arms are pivotally mounted to housing 44, as at 62, for pivotal movement of the actuator between its open and closed positions. The pivot at 62 is provided by a keyhole-shaped opening for receiving an oblong pivot stub shaft 64 projecting outwardly from opposite sides of the housing. The front corners of the actuator have downwardly extending guide tabs 60*c* which slidingly engage inside side walls 54*b* of fitting nail plate 54 as seen in FIGS. 2 and 5. When the actuator is pivoted downwardly to its closed position, the actuator can be pushed inwardly in the direction of arrow "A". This causes the oblong pivot stub shafts to move into the narrow portions of keyhole-shaped openings 62 to latch the actuator in its closed position.

According to the invention, actuator 60 is provided with first magnetic means whereby the actuator is drawn downwardly to its closed position due to magnetic attraction forces from a second magnetic means mounted somewhere below the actuator. In the embodiment of FIGS. 1–7, fitting nail plate 54 which, as stated above, preferably is fabricated of iron material, forms a second magnetic means which is effective to draw the magnetized actuator downwardly against flat circuit 42 due to the magnetic attraction forces between the magnetic actuator and the magnetic fitting nail plate.

In the embodiment of FIGS. 1–7, actuator 6 is formed as a permanent magnet that is produced by molding magnetic particles, such as ferrite powder 65, in a matrix. The actuator is molded in the shape shown in FIGS. 1 and 2 and is then magnetized.

FIG. 5 simply shows in phantom, as at 66, how actuator 60 might bow if it is fabricated as thin as rectangular body portion 60*b* of actuator 60 is shown in FIG. 5. However, with the entire actuator being magnetized, the very thin body portion of the actuator is drawn tightly onto the top of the flat circuit and, thereby, provides an extremely low profile for connector 40 as is clearly shown in FIG. 5.

Figure 8:
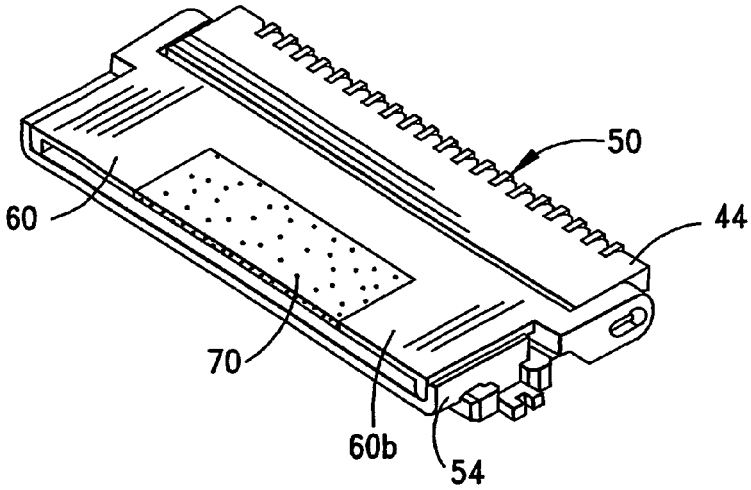
FIG. 8 is a perspective view of a connector according to a second embodiment of the invention.

FIG. 8 shows a second embodiment of the invention wherein actuator 60 is substantially molded of a dielectric material such as plastic or the like. However, a permanent magnetic plate 70 is insert-molded in body 60*b* of the actuator generally centrally between opposite ends or sides thereof. This permanent magnet plate forms the first magnetic means for the actuator which is effective to draw the actuator down onto the flat circuit.

Figure 9:
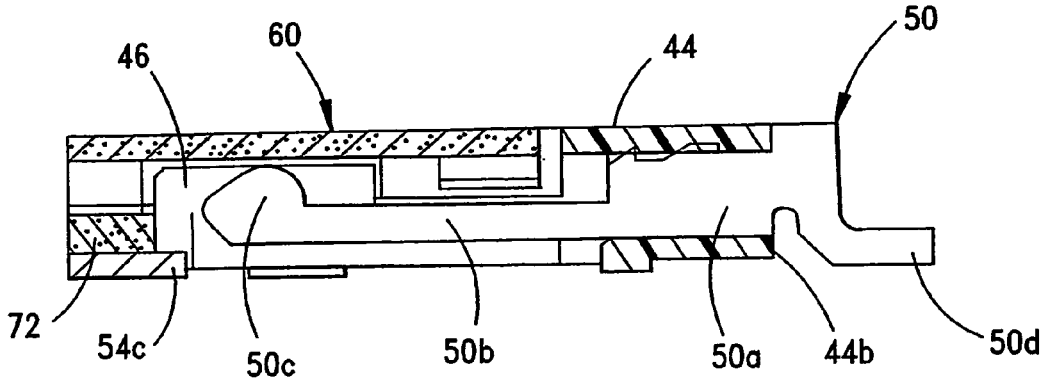
FIG. 9 is a perspective view of a connector according to a third embodiment of the invention.

FIG. 9 shows a third embodiment of the invention wherein a permanent magnet plate 72 is mounted on top of bottom plate 54*c* of fitting nail plate 54. With this embodiment, a magnetic attractive force is induced to mutually attract magnetized actuator 60 and permanent magnet plate 72. With the permanent magnet plate being fixed, the magnetic forces draw the actuator downwardly to its closed position.

Figure 10:
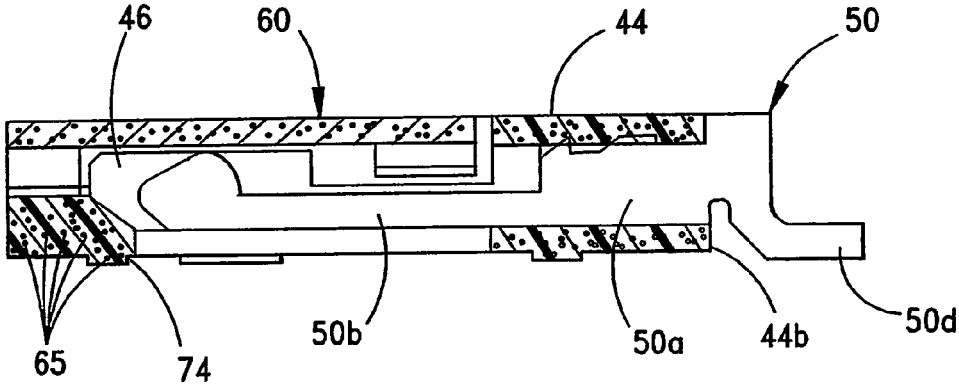
FIG. 10 is a perspective view of a connector according to a fourth embodiment of the invention.

FIG. 10 show a fourth embodiment of the invention wherein the fitting nail plate is replaced by an additional bottom wall 74 of the housing to extend forwardly below the circuit-receiving opening 46. This additional bottom wall may be fabricated of a plastic material having magnetic particles 65 embedded therein, or the additional bottom wall may be provided as a permanent magnet plate. With such alternatives, a permanent magnetized actuator can be replaced with some means comprising a ferromagnetic substance such as an iron plate. Thus, magnetic attractive forces are induced between the iron actuator and the permanent magnet plate 74.

Figure 11:
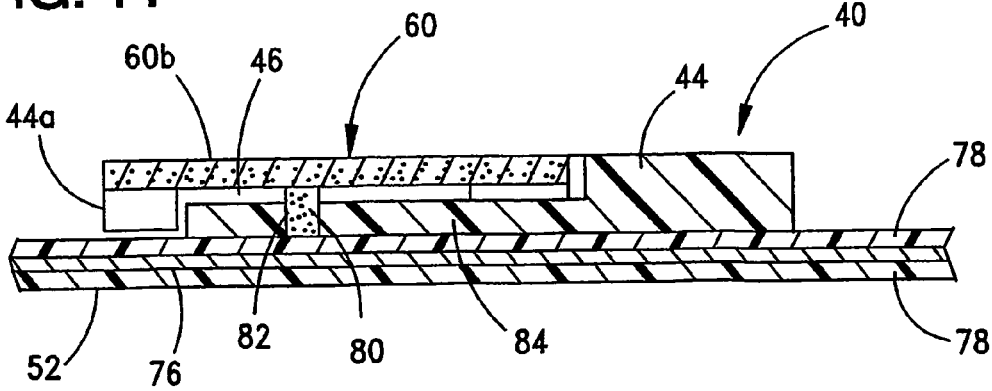
FIG. 11 is a perspective view of a connector according to a fifth embodiment of the invention.

FIG. 11 shows a fifth embodiment of the invention wherein printed circuit board 52 is laminated or of a laminar construction. Specifically, an iron layer 76 is sandwiched between a pair of dielectric layers 78. Iron layer 76 is of a ferromagnetic substance. Therefore, if actuator 60 is fabricated as a permanent magnet as described in the embodiment of FIGS. 1–6, the magnetized actuator is drawn downwardly by the magnetic attraction forces with the iron plate embedded in the printed circuit board. In the embodiment of FIG. 11, terminals 50 of the previous embodiments may be replaced with a plurality of terminal plugs 80 fixed within holes 82 in a wall 84 of housing 44. The terminal plugs are fabricated of conductive rubber material and electrically connect the conductors on the bottom of the flat circuit with appropriate circuit traces on the top of printed circuit board 50.

Figure 12:
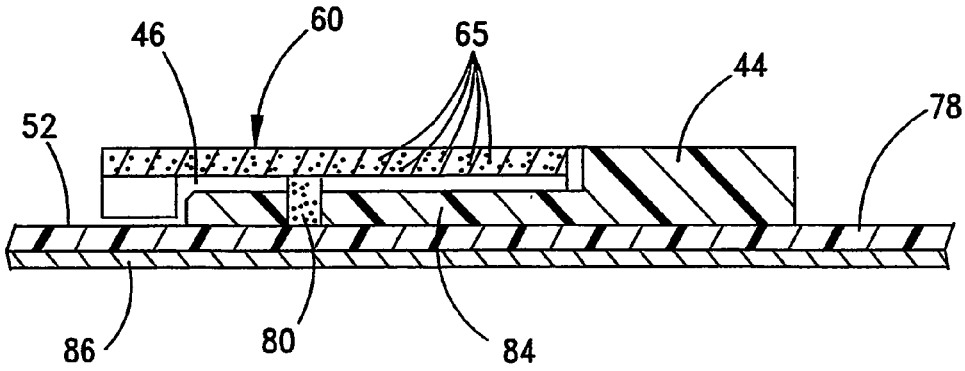
FIG. 12 is a perspective view of a connector according to a sixth embodiment of the invention.

FIG. 12 shows a sixth embodiment of the invention, wherein printed circuit board 80, again, is laminated with a bottom layer 86 of magnetic material, such as iron.

Figure 13:
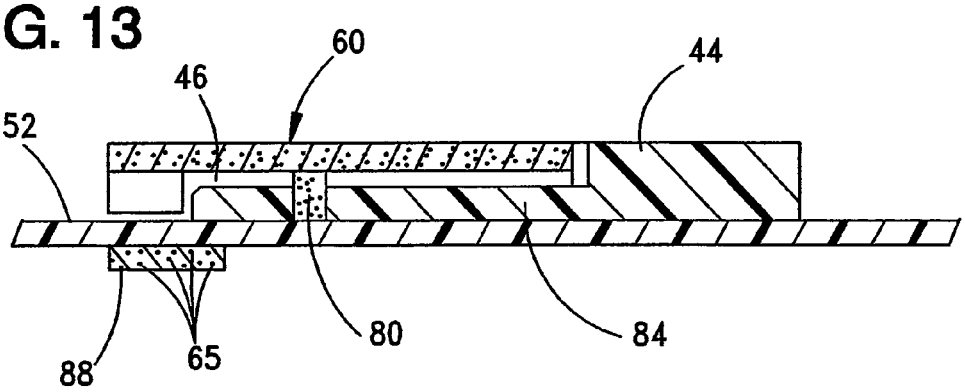
FIG. 13 is a perspective view of a connector according to a seventh embodiment of the invention.

FIG. 13 shows a seventh embodiment of the invention wherein a permanent magnet plate 88 is mounted on or in circuit board 52. Plate 82 may be formed from some ferromagnetic substance such as an iron plate.

Figure 14:
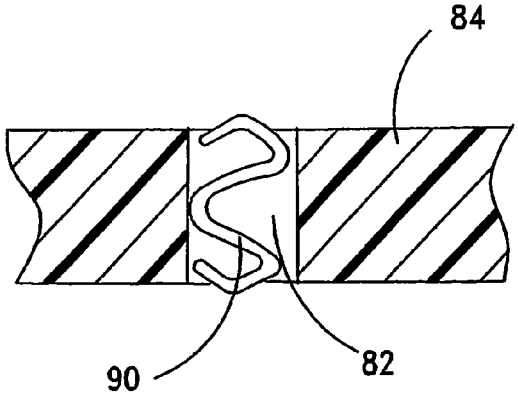
FIG. 14 is a fragmented sectional view illustrating a spring contact used as a resilient conductive member.
Figure 15:
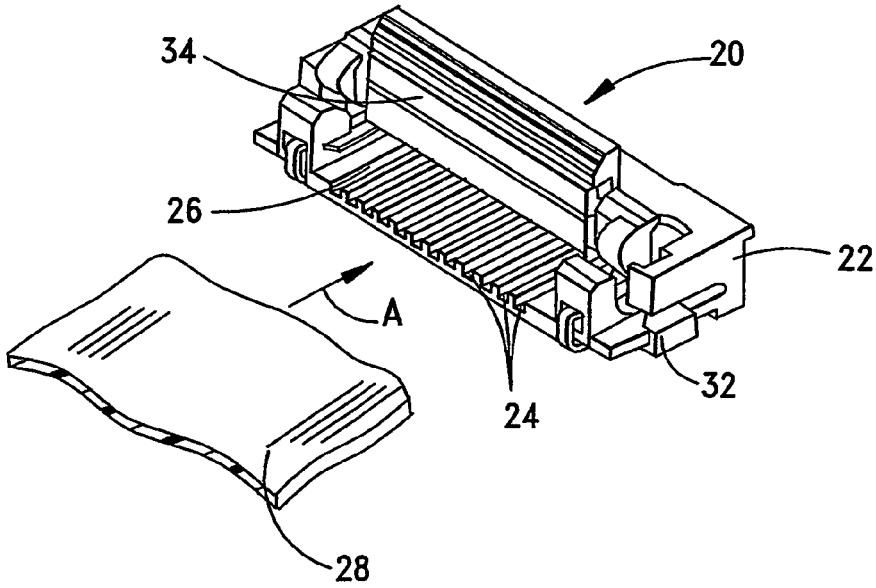
FIG. 15 (PRIOR ART)
FIG. 15 is a perspective view of a connector according to the prior art and described in the "Background" above.
Figure 16:
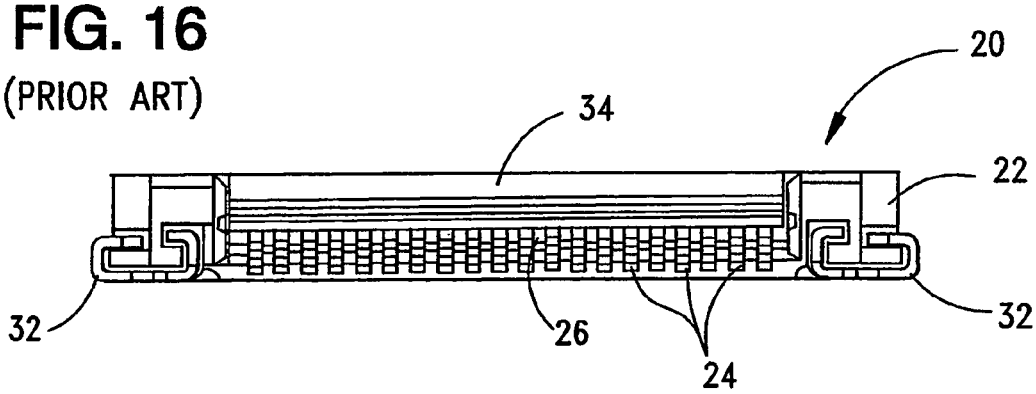
FIG. 16 (PRIOR ART)
FIG. 16 is a front elevational view of the prior art connector.
Figure 17:
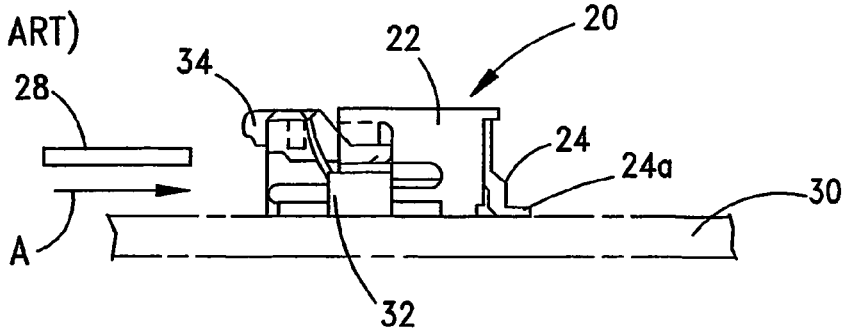
FIG. 17 (PRIOR ART)
FIG. 17 is a right-hand side elevational view of the prior art connector.

FIG. 14 simply shows an alternative configuration to replace the terminal plugs 80 described above in relation to the embodiment of FIG. 11 and also shown in the embodiments of FIGS. 12 and 13. According to the embodiment of FIG. 14, a plurality of spring terminals 90 are disposed in holes 82 in wall 84 of the housing. These spring terminals are effective to electrically connect the conductors on the bottom of the flat circuit with the circuit traces on the top of printed circuit board 52.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

The invention claimed is:

1. An electrical connector for terminating a flat electrical circuit, comprising:

a dielectric housing having an opening for receiving an end of a flat circuit;

a plurality of terminals mounted on the housing in a side-by-side array and having contact portions spaced laterally along the opening;

an actuator movably mounted on the housing for movement between an open position allowing the flat circuit to be inserted into said opening and a closed position biasing the flat circuit against the contact portions of the terminals, the actuator being provided with first magnetic means; and second magnetic means disposed on the dielectric housing and comprising at least a portion of the housing being molded of magnetic material for drawing the actuator to its closed position due to magnetic attraction forces between the first and second magnetic means.

2. The electrical connector of claim 1 wherein said actuator is at least partially molded of a magnetic material to provide said first magnetic means.

3. The electrical connector of claim 2 wherein said magnetic material of the actuator comprises a matrix having magnetic particles embedded therein.

4. The electrical connector of claim 3 wherein said magnetic particles comprise ferrite particles.

5. The electrical connector of claim 3 wherein said actuator is molded substantially entirely of said magnetic material.

6. The electrical connector of claim 1 wherein said first magnetic means of the actuator comprises a permanent magnet disposed thereon.

7. The electrical connector of claim 6 wherein said actuator is elongated and said permanent magnet is disposed generally centrally between opposite ends of the elongated actuator.

8. The electrical connector of claim 1 wherein said second magnetic means comprise at least one permanent magnet.

9. The electrical connector of claim 1 wherein said housing is adapted for mounting on a circuit board, and said second magnetic means is provided on the circuit board.

10. The electrical connector of claim 9 wherein said second magnetic means comprise at least one permanent magnet.

11. The electrical connector of claim 9 wherein said second magnetic means comprises a molded magnetic material.

12. The electrical connector of claim 11 wherein said magnetic material comprises a matrix having magnetic particles embedded thereon.

13. The electrical connector of claim 12 wherein said magnetic particles comprise ferrite particles.

14. The electrical connector of claim 9 wherein said circuit board is laminated with at least one magnetic layer.

15. An electrical connector for terminating a flat electrical circuit, comprising:

a dielectric housing having a circuit-receiving opening for receiving an end of a flat circuit;

a plurality of terminals mounted on the housing in a side-by-side array and having contact portions spaced laterally along the opening;

an actuator movably mounted on the housing for movement between an open position allowing the flat circuit to be inserted into said opening and a closed position biasing the flat circuit against the contact portions of the terminals, said actuator at least partially molded of magnetic material to provide first magnetic means;

first magnetic means mounted on the actuator above said circuit-receiving opening; and second magnetic means, comprising at least a portion of the housing being molded of magnetic material, and being located below said circuit-receiving opening, whereby the first and second magnetic means are effective due to magnetic attraction forces to draw the actuator to its closed position.

16. The electrical connector of claim 15 wherein at least one of said first and second magnetic means comprises a permanent magnet.

17. The electrical connector of claim 15 wherein at least one of said first and second magnetic means comprises a matrix having magnetic particles embedded therein.

* * * * *